US005402609A

United States Patent [19]

Kelley, Jr.

[11] Patent Number: 5,402,609

[45] Date of Patent: Apr. 4, 1995

[54] CONCRETE BUILDING BLOCK SYSTEM

[76] Inventor: Michael L. Kelley, Jr., 3120 Freeman Rd. E., Puyallup, Wash. 98371

[21] Appl. No.: 929,726

[22] Filed: Aug. 13, 1992

[51] Int. Cl.[6] ..... E04B 1/04

[52] U.S. Cl. ..... 52/98; 52/122.1; 52/124.2; 52/125.1; 52/125.2; 52/561; 52/570; 52/604; 52/605; 52/606; 52/607; 52/699; 52/707; 52/708

[58] Field of Search ..... 52/98, 122.1, 124.2, 52/125.1, 125.2, 125.3, 125.4, 125.5, 604–608, 561, 562, 564, 565, 570, 699, 707, 708, 712; 108/51.1

[56] References Cited

U.S. PATENT DOCUMENTS

| | | | |
|---|---|---|---|
| 689,523 | 12/1901 | Trumbull . | |
| 802,566 | 10/1905 | Harris | 52/564 |
| 1,959,816 | 5/1934 | Crum | 52/98 |
| 1,968,393 | 7/1934 | Henderson | 52/98 |
| 1,992,785 | 2/1935 | Stever | 52/605 X |
| 2,262,130 | 11/1941 | Bagley | 52/699 X |
| 2,644,327 | 7/1953 | Clements . | |
| 2,703,487 | 3/1955 | Ossoinack | 52/607 X |
| 3,116,570 | 1/1964 | Torricelli . | |
| 3,176,468 | 4/1965 | Nagai et al. . | |
| 3,305,982 | 2/1967 | Steele . | |
| 3,676,971 | 7/1972 | Dombroski . | |
| 3,894,397 | 7/1975 | Fair . | |
| 3,998,423 | 12/1976 | Mullins . | |
| 4,031,678 | 6/1977 | Schuring . | |
| 4,078,760 | 3/1978 | Mullins . | |
| 4,093,174 | 6/1978 | Mullins . | |
| 4,186,540 | 2/1980 | Mullins . | |
| 4,187,069 | 2/1980 | Mullins . | |
| 4,262,951 | 4/1981 | Hoyer . | |
| 4,436,447 | 3/1984 | Crowe . | |
| 4,671,039 | 6/1987 | Hunt . | |
| 4,833,856 | 5/1989 | Zwagerman | 52/604 X |
| 4,920,712 | 5/1990 | Dean, Jr. | 52/699 X |

FOREIGN PATENT DOCUMENTS

| | | | |
|---|---|---|---|
| 0056694 | 9/1939 | Denmark | 52/605 |
| 2405331 | 8/1974 | Germany | 52/605 |
| 0145908 | 3/1931 | Switzerland | 52/604 |

*Primary Examiner*—Carl D. Friedman
*Assistant Examiner*—Robert Canfield
*Attorney, Agent, or Firm*—Delbert J. Barnard

[57] ABSTRACT

A concrete building block (2) has complementary projections (10) and recesses (12) to cause it to interlock with other blocks (2). A T-shaped channel (16, 26) on the top surface (4) receives an anchor member (32). A projecting end (36) of the member (32) may be secured to an anchor cable (104). The ends of a metal cable (22) are embedded in the block (2) with an eye portion (24) projecting into an increased depth channel portion (20). The lower surface (6) of the block (2) has parallel channels (28) for receiving the tines of a forklift. The channels (16, 28) have breakaway walls (18, 30) at their outer ends, which are not broken away unless the channels (16, 28) are to be used. The walls (18, 30) prevent concrete from flowing out of the channels (16, 28) when reinforcing concrete is poured through vertical openings (14) in the block (2). In molding the block (2), slugs (86) are releasably attached to opposite mold walls to form the openings (14). Notched and three-quarter size blocks (2B, 2C) may be used to form a T-shaped structure. Another modification is an angled block (2A) for forming an angled wall.

13 Claims, 9 Drawing Sheets 36
38
119
34
32
40
10
2
4
16
18
26
14
20
27
24
10
8
9

7
8
9
36
38
16
4
34
10
14
27
5
6
40
26
24
20
10
14
5
6
7
8
9
8

CONCRETE BUILDING BLOCK SYSTEM

TECHNICAL FIELD

The present invention relates to concrete building blocks and methods of making and using the same and, more particularly, to a system that employs a block having an opening extending therethrough between opposite surfaces for receiving reinforcing metal rods and concrete, channels formed on the opposite surfaces for handling and anchoring the block, and breakaway walls at the outer ends of the channels to prevent flow of reinforcing concrete from the channels.

BACKGROUND INFORMATION

Concrete building blocks are widely used in the construction of a variety of structures. A major use of such blocks is in the building of temporary or permanent retaining walls. Blocks used in such walls frequently have interlocking upper and lower surfaces so that the blocks automatically interlock when they are positioned one atop another. This automatic interlocking allows the walls to be built without mortar to expedite the building procedure and to permit the walls to be disassembled, if desired, when they are no longer needed. Because of their mortarless construction and lack of a foundation, the walls require stabilizing. One technique for providing stability is to fill aligned vertical openings in the blocks with reinforced concrete. Known concrete building block systems have limited versatility with regard to both handling of the individual blocks and stabilizing of structures made from the blocks.

SUMMARY OF THE INVENTION

The present invention is a concrete building block system. The system includes a concrete building block, a mold and a method of forming concrete building blocks, and methods of using such blocks.

A subject of the invention is a structural building block comprising a concrete body. According to an aspect of the invention, the body comprises a top surface, an opposite bottom surface, and an opening extending through the body between and through these surfaces. The body has a channel in one of the surfaces. The channel extends from a midportion of the surface toward an edge of the surface and terminates in an outer end portion proximate to the edge. A breakaway wall is defined between the outer end portion of the channel and the edge. The wall is sufficiently thin and brittle to permit it to be broken away by use of hand tools. The wall is configured to prevent flow of concrete from the channel.

The channel in the block body may have various configurations and be used for various purposes. It is presently anticipated that, in blocks constructed according to the invention, the channel will be used primarily to facilitate handling the block and/or anchoring a wall into which the block has been incorporated. For example, in an embodiment of the invention, the block further comprises a connector which has an embedded portion embedded in the block body, and an eye portion extending from the body into the channel. In this embodiment, the eye portion may be engaged by a hook or other engagement member for lifting the block. In the preferred form of this embodiment, the channel includes an increased depth portion into which the connector eye portion extends. This arrangement helps ensure that the eye portion does not extend beyond the main surface of the block and, therefore, does not interfere with the stacking of the block with other blocks. The arrangement also provides access to the eye portion through a channel when the block is surrounded by other blocks.

A feature of the invention is the provision of first and second channels in the bottom surface of the block. The two channels are substantially parallel to and coextensive with each other. Each channel has a breakaway wall, as described above. The channels are spaced apart a distance such that, when the breakaway walls are broken away, the channels will admit tines of a forklift to permit the forklift to maneuver the block. In the construction of a wall, the use of blocks having the combination of forklift channels and breakaway walls on the outer ends of the channels permits handling of individual blocks by a forklift while preserving the appearance of blocks that do not need to be handled by the forklift and minimizing the need for damming of channel ends during procedures in which reinforcing concrete is poured through the openings in the block bodies.

Another feature of the invention is the provision of a first main channel, as described above, and a second transverse channel that extends substantially perpendicular to and intersects the main channel. The two channels together form a substantially T-shaped recess in the block surface. The transverse channel is partially defined by an abutment sidewall that is substantially parallel to and faces away from the edge of the surface proximate to the outer end portion of the main channel. The abutment sidewall reacts anchor forces imposed by an anchor member positioned in the T-shaped recess in an abutting relationship with the abutment sidewall. The anchor member is connected to a remote anchor point. The block may be provided in combination with such an anchor member. The anchor member is positionable in the recess when the breakaway wall is broken away. The anchor member has a leg portion with an outer end that projects outwardly from the main channel when the anchor member is positioned in the recess. A head portion of the anchor member is positionable in the transverse channel in an abutting relationship with the abutment sidewall to react forces imposed by an anchor cable secured to the outer end of the leg portion.

According to another aspect of the invention, the concrete body of the building block comprises a top surface and an opposite bottom surface. These surfaces have complementary interlocking portions arranged to cause the surfaces of a plurality of the blocks to automatically interlock when the blocks are positioned one atop another. The block body also includes a pair of channels formed in the bottom surface. Each channel extends from a midportion of the bottom surface at least substantially all the way to an edge of the bottom surface. The channels are substantially parallel to each other and spaced from each other a distance such that the channels will admit the tines of a forklift. In the preferred embodiment of this aspect of the block, a breakaway wall is defined between the outer end portion of each channel and said edge of the bottom surface.

According to still another aspect of the invention, the concrete block body comprises top and bottom surfaces and interlocking portions, as described above, and a substantially T-shaped recess formed in the top surface. The recess has a leg portion extending from a midportion of the top surface at least substantially all the way to an edge of the top surface. A head portion of the recess intersects the leg portion and extends substantially parallel to the said edge and substantially perpendicular to the leg portion. The head portion is partially defined by an abutment sidewall that is substantially parallel to and faces away from Said edge to react anchor forces imposed by an anchor member positioned in the recess and connected to a remote anchor point. Like the pair of channels described in the last paragraph, the leg portion of the recess preferably has a breakaway wall formed at its outer end.

Another subject of the invention is a mold for forming a concrete building block. The mold comprises a plurality of walls releasably attachable to each other to define a cavity into which concrete can be poured. The walls include first and second walls opposed to and spaced from each other when the plurality of walls are attached to each other. The mold also includes at least one elongated slug having first and second ends releasably attachable to the first and second walls, respectively. The slug functions to form an opening through a block cast in the cavity and to reinforce the mold during forming of a block. The use of the slug allows the opening to be accurately and reliably formed while maintaining the ease of assembly and disassembly of the mold. The ends of the slug may be attached to the opposite walls in various ways. In the preferred embodiment, the first wall includes a socket into which the first slug end is received, and the second slug end is attached to the second wall by means of a fastener.

The mold of the invention may also include a variety of projections and/or recesses for forming, respectively, recesses and projections on the cast concrete block. In the preferred embodiment of the mold, a projection is formed on one of the first and second walls and projects into the cavity when the plurality of walls are attached to each other, to form a channel along a surface of a block cast in the mold. The projection has an end wall substantially perpendicular to the mold wall on which the projection is formed and close to, but spaced a distance from, an edge of this wall. The distance is sufficiently small to create a breakaway wall at the end of the channel in the cast block.

Another preferred feature of the mold of the invention is a projection formed on one of the first and second walls to form a recess in a surface of a block cast in the mold. The projection has an outer wall that is substantially parallel to the wall on which the projection is formed. An opening through the outer wall is sized to permit a portion of a connector to project outwardly from the cavity and into the recess. This feature of the mold facilitates the provision of the cast block with an embedded connector with a protruding eye portion.

A third subject of the invention is a method of forming a concrete building block. This method comprises providing a plurality of walls and an elongated slug. The walls are releasably attached to each to form a cavity. The attaching of the walls includes positioning first and second ones of the walls opposite to and spaced from each other, and releasably attaching opposite ends of the slug to the first and second walls. The cavity is filled with concrete, which is allowed to harden into a block. The walls are released from each other and separated from each other and from the block. The slug is released from at least one of the first and second walls and removed from the block to form an opening through the block.

As noted above, the system of the invention also encompasses methods of using the invention. One such method is a method of anchoring a structure formed by a plurality of blocks with interlocking elements. This method comprises providing at least one of the blocks with a substantially T-shaped recess on its upper surface, and providing a substantially T-shaped anchor member complementary in shape to the recess. The anchor member is positioned in the recess with an end of a leg portion of the member projecting outwardly from the recess at an edge of the block's upper surface and a head portion of the member abutting a sidewall of the recess, as described above. A second block is positioned on top of the block on which the anchor member has been positioned. The projecting end of the anchor member is secured to a first end portion of an anchor cable, and an opposite end portion of the cable is secured to an anchor. The abutment of the anchor member against the recess sidewall reacts anchor forces imposed by the anchor.

Another method of use is a method of building a structure having a first wall and a second wall perpendicular to, and adjoining a midportion of, the first wall. The method comprises providing a plurality of rectangular full size blocks. Each block has opposite top and bottom surfaces, with each such surface comprising two adjoining square portions. Each square portion has a first area and includes interlocking portions. The interlocking portions of the top surfaces are complementary to the interlocking portions of the bottom surfaces. At least two notched blocks and at least one rectangular three-quarter size block are also provided. The notched blocks are configured like the full size blocks except that each of the notched blocks has a square corner recess extending through its top and bottom surfaces. The recess has a cross section with an area one-quarter of the first area. The notched blocks are mirror images of each other. The three-quarter size block is configured like the full size blocks except that each of its top and bottom surfaces comprises one and a half of said square portions. The notched blocks are positioned end-to-end with the corner recesses adjacent to each other, to form a part of the midportion of the first wall. An end portion of the three-quarter size block is positioned in the corner recesses in abutment with the notched blocks. A first one of the full size blocks is positioned above and interlocking with the botched blocks and the three-quarter size block. A different square portion of the bottom surface of the full size block is positioned over each of the notched blocks. Additional full size blocks are placed above and below the positioned blocks, to interlock with each other and the positioned blocks and to extend the first and second walls.

The system of the invention is comprehensive and highly versatile. It permits the building of a wide range of configurations of retaining walls and other structures while requiring a minimum number of different block types. The system of the invention includes a method and apparatus for manufacturing concrete building blocks that enable efficient and economical manufacture and that are suitable for both small scale and larger scale operations. The manufacturing subsystem is also very flexible to accommodate a variety of manufacturing conditions and readily incorporate variations in block configurations. The invention also provides building blocks and methods of using them that help maximize the ease of handling the blocks and of anchoring structures into which the blocks are incorporated. In accordance with the invention, retaining walls and other structures may be reliably anchored while maintaining ease of engagement and disengagement of the anchor from the structure. The preferred form of the block of the invention provides a combination of one or more channels and openings extending through the block. The channels may be provided in various configurations to increase the available options for handling and/or anchoring the blocks during construction of walls and other structures using the blocks. The inclusion of breakaway walls in the blocks allows these enhanced options to be made available while, at the same time, minimizing the need to dam the channels when reinforcing concrete is poured into the openings. The inclusion in the system of the invention of the notched and three-quarter size block variations provides a means for readily and reliably building perpendicular walls that are structurally interconnected and mutually supporting.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 15:
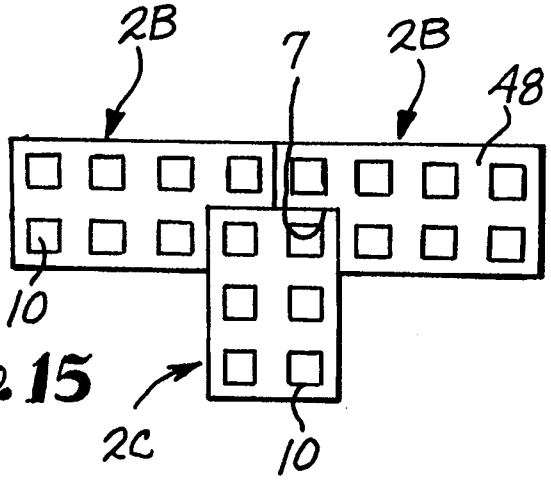
FIG. 15 is a schematic top plan view of a perpendicular intersection of two walls formed by two modifications of the block shown in FIGS. 1–9.
Figure 16:
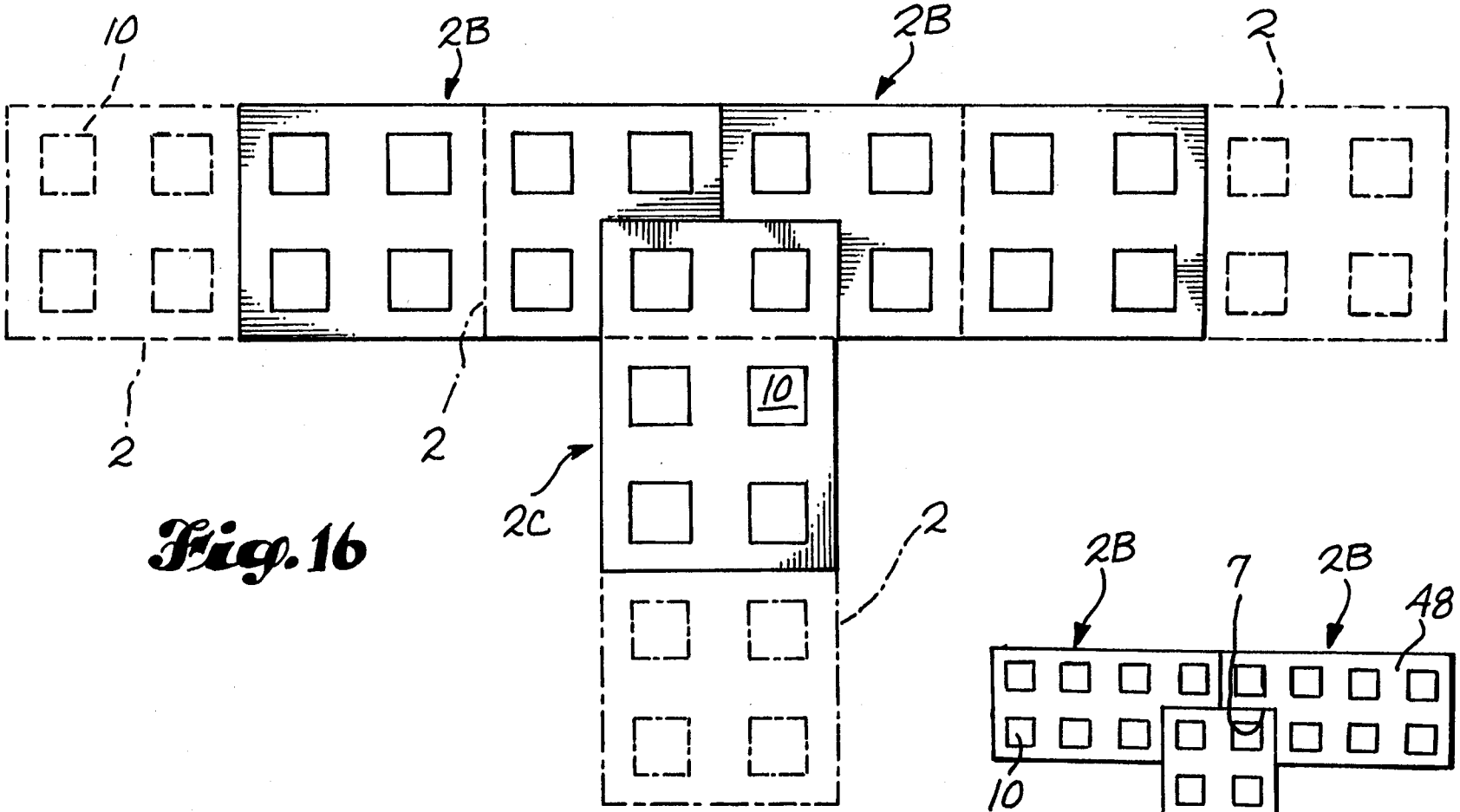
FIG. 16 is a schematic top plan view of the arrangement shown in FIG. 15 with a second layer of blocks shown in phantom.
Figure 17:
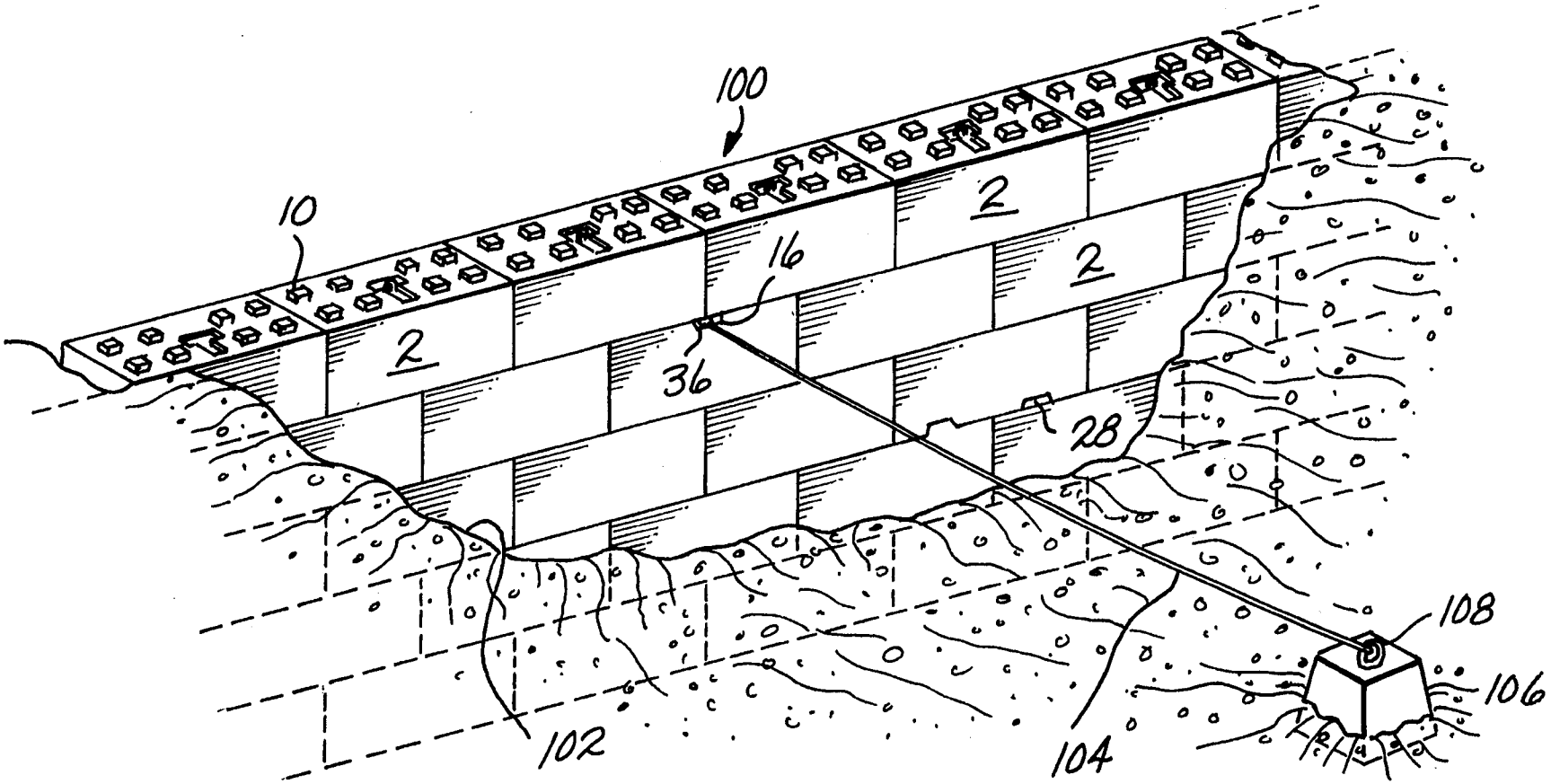
FIG. 17 is a pictorial view of a retaining wall and anchor constructed in accordance with the invention.

The drawings show four embodiments of a structural concrete building block, 2, 2A, 2B, 2C that are constructed according to the invention and that constitute the best modes of the block of the invention currently known to the applicant. FIGS. 10, 10A, and 12–14 illustrate the best modes of the mold of the invention currently known to the applicant. FIGS. 10, 10A, and 12–17 illustrate the best modes for carrying out the methods of the invention currently known to the applicant. In FIG. 17, a retaining wall 100 built with the basic form of the block 2 for retaining an embankment 102 is shown. The illustrated use is only one of a variety of uses of the block of the invention. It is intended to be understood that the block may also be used in the construction of other types of structures and in other situations without departing from the spirit and scope of the invention.

The basic rectangular form of the block 2 is shown in FIGS. 1–9. The block 2 has opposite rectangular upper and lower surfaces 4, 6; opposite end surfaces 9 perpendicular to and extending between the upper and lower surfaces 4, 6; and opposite side surfaces perpendicular to the upper and lower surfaces 4, 6 and the end surfaces 9. The side surfaces include the corrugated side surface 8 best seen in FIGS. 1 and 3 and a smooth side surface. The upper and lower surfaces 4, 6 have complementary interlocking portions arranged to cause the surfaces 4, 6 to automatically interlock when a plurality of the blocks 2 are positioned one atop another. In the preferred embodiment shown in FIGS. 1–9, these interlocking portions include projections 10 on the upper surface 4 and corresponding recesses 12 extending into the lower surface 6. The projections 10 and recesses 12 are arranged in two groups of four each. Each of the rectangular upper and lower surfaces 4, 6 comprises two adjoining square portions. The imaginary line along which the two square portions of the lower surface 6 adjoin is shown in phantom in FIG. 4. One group of projections 10 or recesses 12 is positioned on each of the square portions in a symmetrical arrangement with each projection 10 or recess 12 positioned in a different corner portion of the respective square portion.

The upper and lower surfaces 4, 6 of the block 2 are typically four feet by two feet. The block thickness is typically two feet for a full thickness block, or one foot for a special purpose thin block. As shown in FIGS. 1–9, each projection is six inches square at its base and tapers upwardly to a four and a half inch square top surface.

The symmetrical adjoining square configuration of the blocks' upper and lower surfaces 4, 6 makes it possible to stack the blocks 2 to form a structure in a variety of ways. The blocks 2 may, of course, be stacked in a vertically aligned arrangement. However, the blocks 2 are preferably staggered to provide a more stable structure. In a staggered arrangement, two blocks 2 are positioned with abutting end surfaces 9, and adjacent corrugated side surfaces 8 facing in the same direction. A third block 2 is placed on top of the first two blocks 2 with one square portion of the lower surface 6 of the third block 2 interlocking with a square portion of the top surface 4 of each of the first two blocks 2. This arrangement effectively interlocks all three blocks 2. Because of the symmetrical arrangement of the projections 10 and recesses 12, the third block 2 may also be positioned perpendicularly to the first block 2 to form a right angle in the structure. In such a case, the second block 2 would also be perpendicular to the first block 2.

Figure 6:
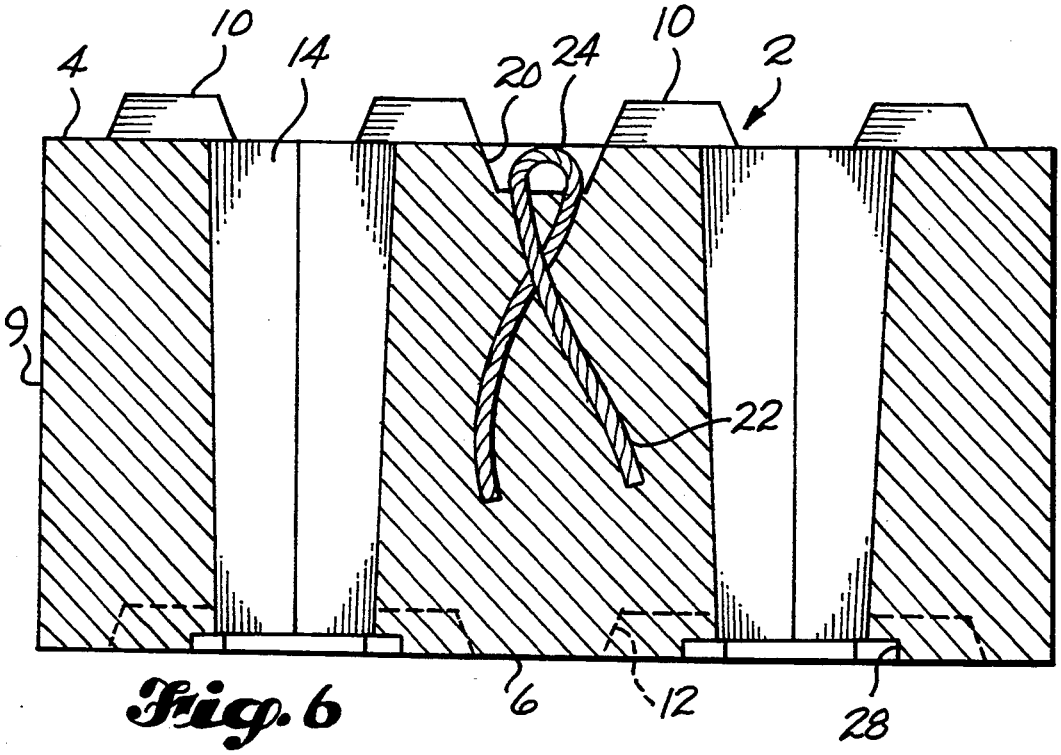
FIG. 6 is a cross-sectional view taken along line 6—6 in FIG. 2.
Figure 7:
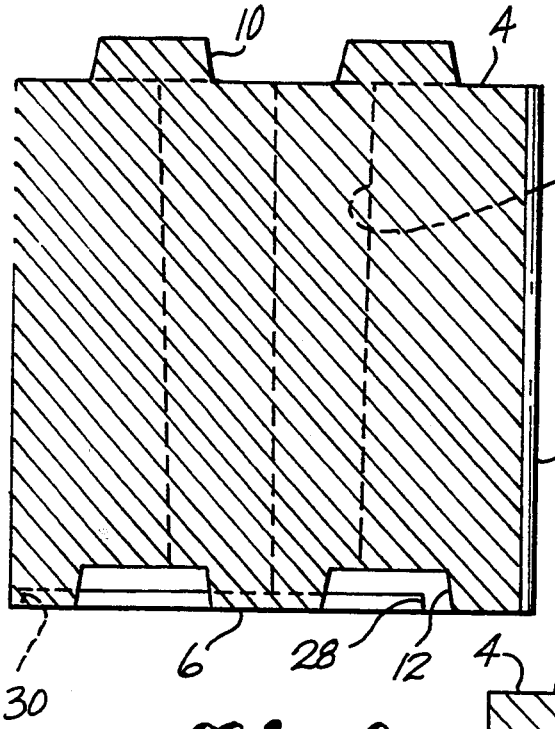
FIG. 7 is a cross-sectional view taken along line 7—7 in FIG. 2.
Figure 8:
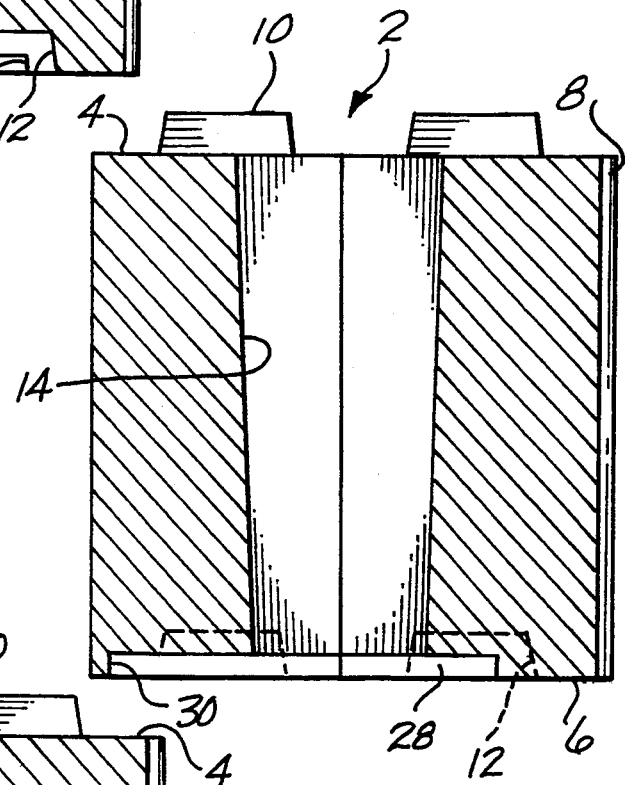
FIG. 8 is a cross-sectional view taken along line 8—8 in FIG. 2.

Each block 2 also has two vertical openings 14 extending through its concrete body between and through the upper and lower surfaces 4, 6, as best seen in FIG. 6. The openings 14 extend substantially perpendicular to the surfaces 4, 6, tapering slightly toward the bottom surface 6 to facilitate manufacture, as described further below. In the illustrated embodiment 2, each opening 14 has a square cross section with sides tapering from eight inches at the top to seven and a half inches at the bottom. The openings 14 may be used for various purposes. It is contemplated that the most common use will be for reinforcing a wall made from the blocks 2. When the blocks 2 are stacked one atop another, whether in alignment or staggered, the openings 14 in the blocks 2 are vertically aligned. Reinforcing rods may be extended through the openings 14. Then, concrete is poured through the openings 14 to form reinforced concrete columns to stabilize the wall.

The blocks of the invention also preferably include one or more channels formed on the upper surface 4 and/or the lower surface 6. These channels may be used, for example, in the anchoring of a structure to increase the structure's stability or for handling the individual block. The preferred form of the upper surface channels is shown in FIGS. 1, 2, 5, 6, and 9. The upper surface channels include a main channel 16 that runs along the top of the block 2 from a midportion of the upper surface 4 toward an edge of the upper surface 4 along which the upper surface 4 joins the smooth side surface. The main channel 16 is perpendicular to this edge of the block 2. The inner portion 20 of the channel 16 opposite the block edge has an increased depth and an increased width. The outer end of the channel 16 terminates proximate to, but spaced a slight distance from, the edge. A breakaway wall 18 is formed between the outer channel end and the edge. This wall 18 is sufficiently thin and brittle to allow it to be broken away by use of hand tools, such as a hammer and chisel. The wall 18 is configured to prevent flow of concrete from the channel 16 during the pouring of reinforcing concrete through the openings 14.

Figure 1:
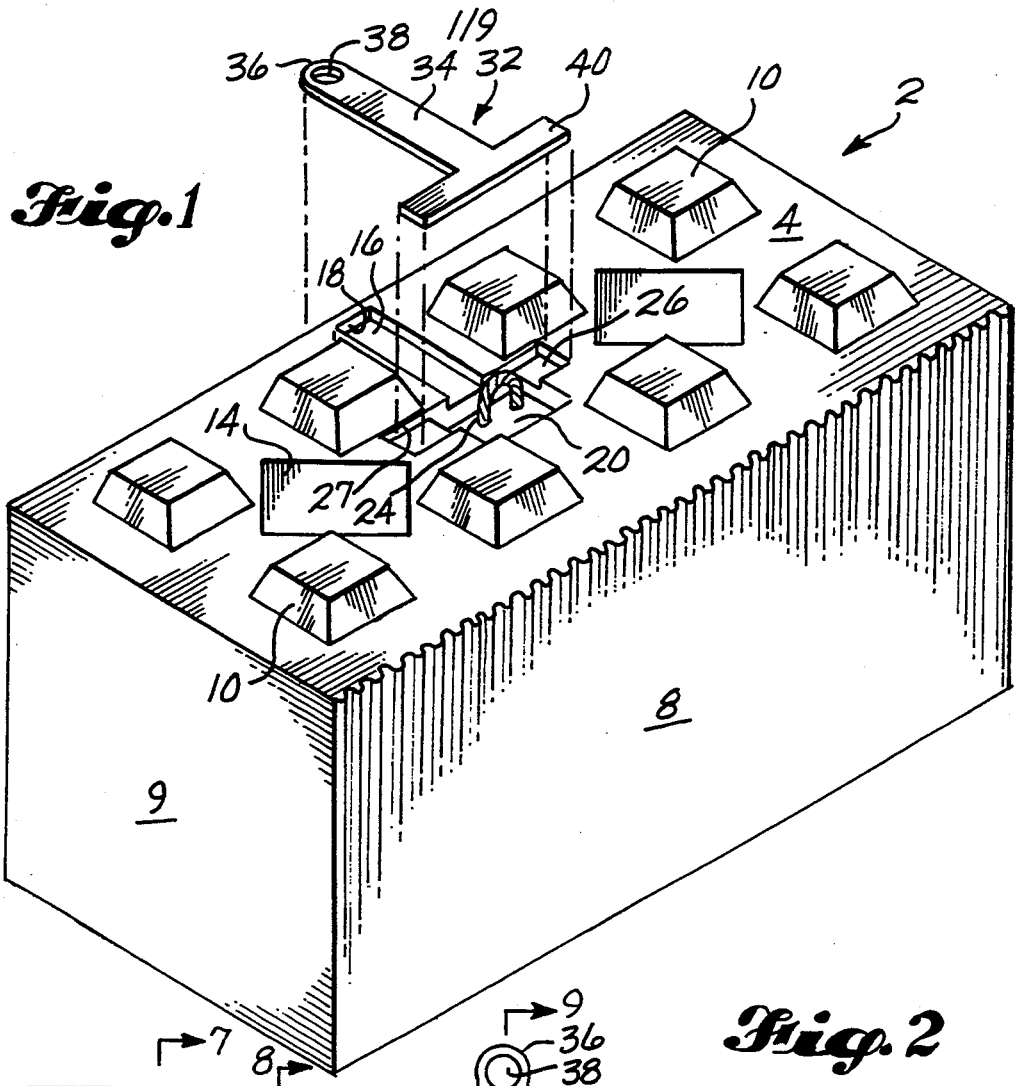
FIG. 1 is an exploded pictorial view of a preferred embodiment of the block and the anchor member of the invention.
Figure 2:
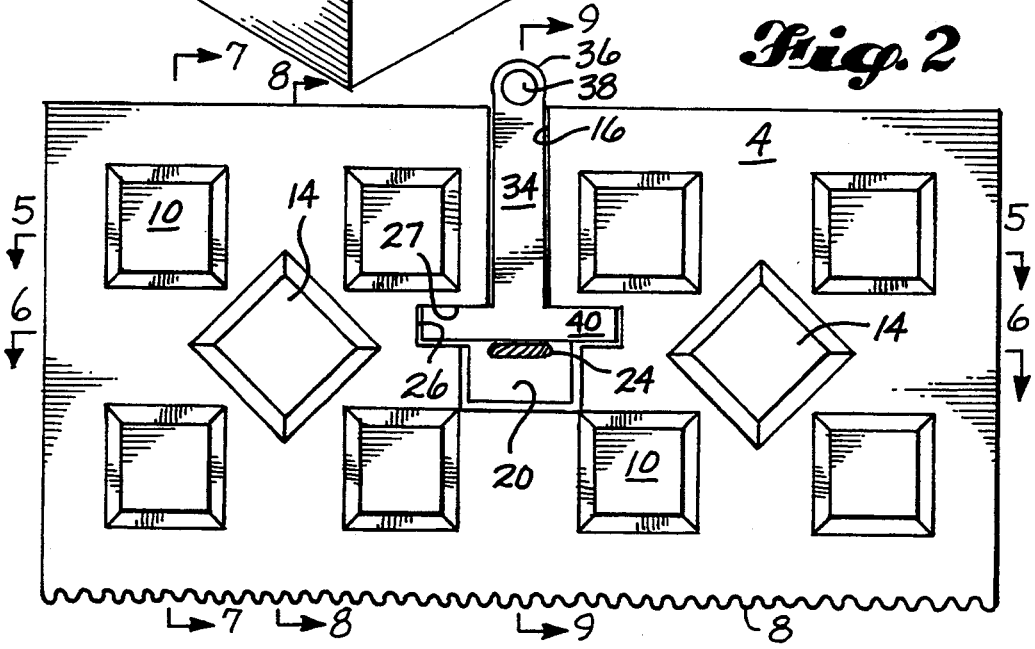
FIG. 2 is a top plan view of the block and the anchor member shown in FIG. 1, illustrating the anchor member installed on the block.
Figure 4:
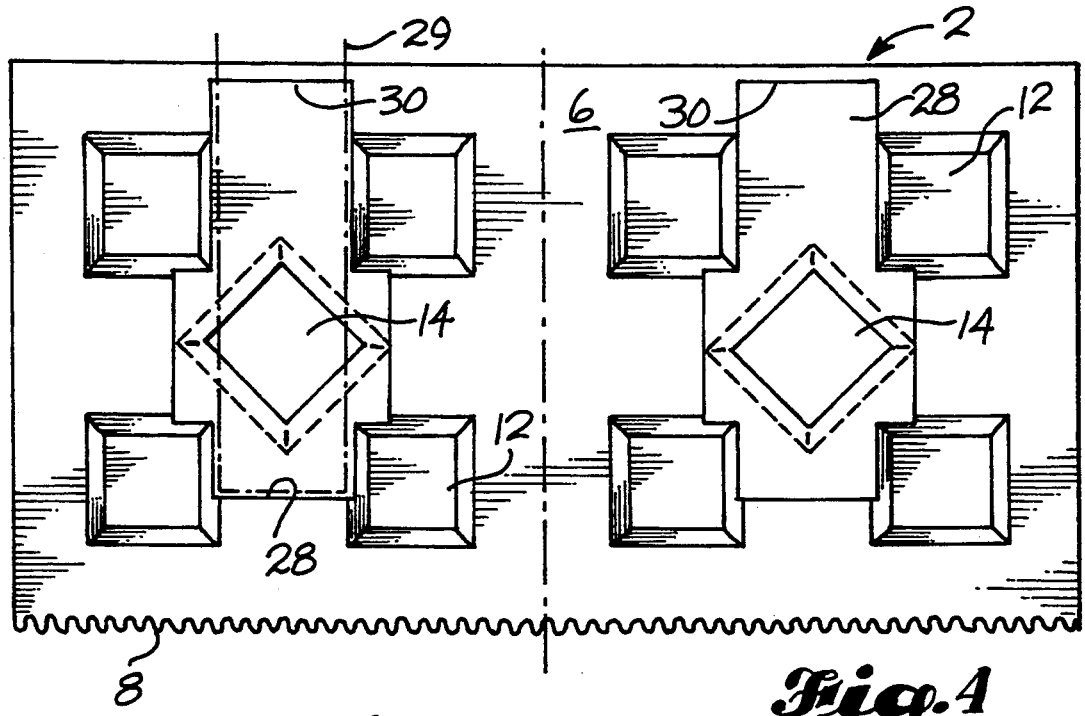
FIG. 4 is a bottom plan view of the block shown in FIGS. 1–3 with a forklift tine shown in broken lines.
Figure 3:
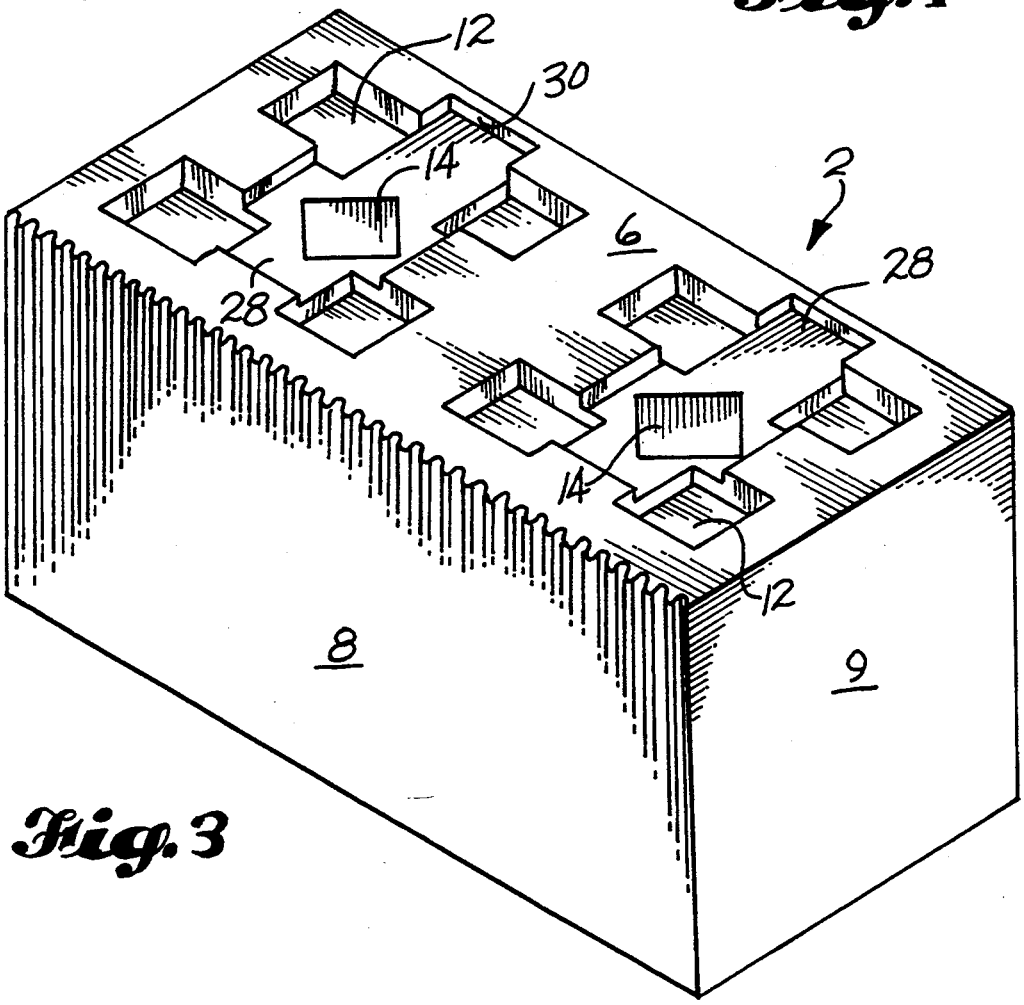
FIG. 3 is a pictorial view of the block shown in FIGS. 1 and 2, looking toward the bottom of the block.
Figure 5:
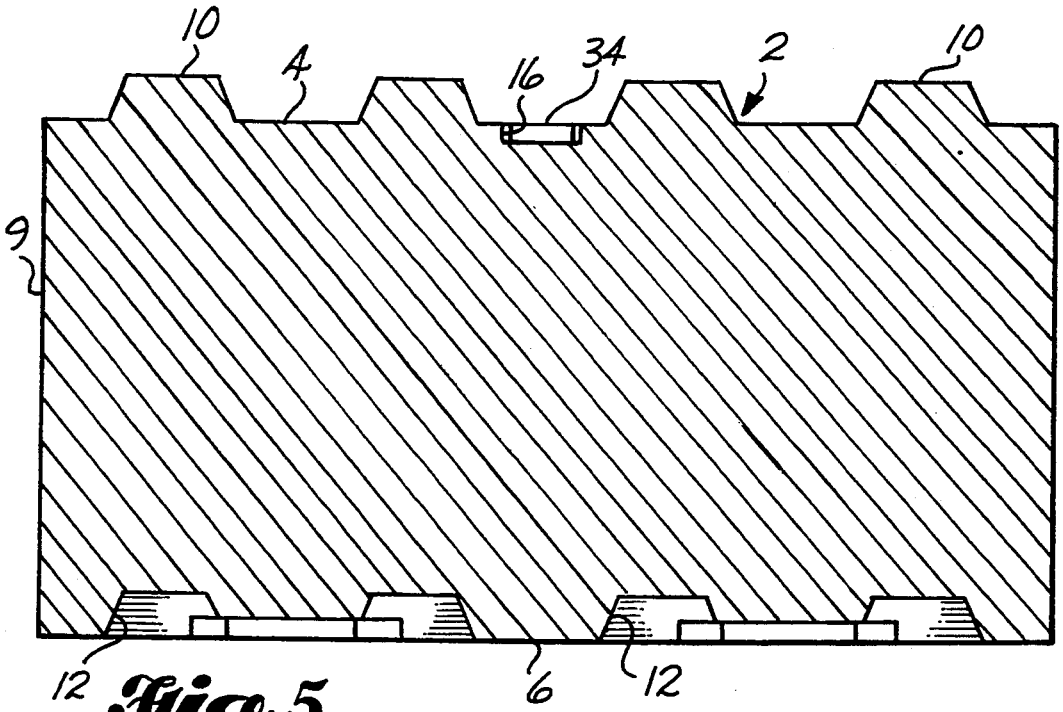
FIG. 5 is a cross-sectional view taken along line 5—5 in FIG. 2.

The channel structure of the upper surface 4 also includes a transverse channel 26 which extends perpendicular to and intersects the main channel 16. As can be seen in FIGS. 1 and 2, the two channels 16, 26 together form a substantially T-shaped recess in the upper surface 4. The transverse channel 26 intersects the increased depth portion 20 of the main channel 16. The increased depth portion 20 extends beyond the T-shaped recess to give the overall channel configuration a cross-like appearance.

Figure 9:
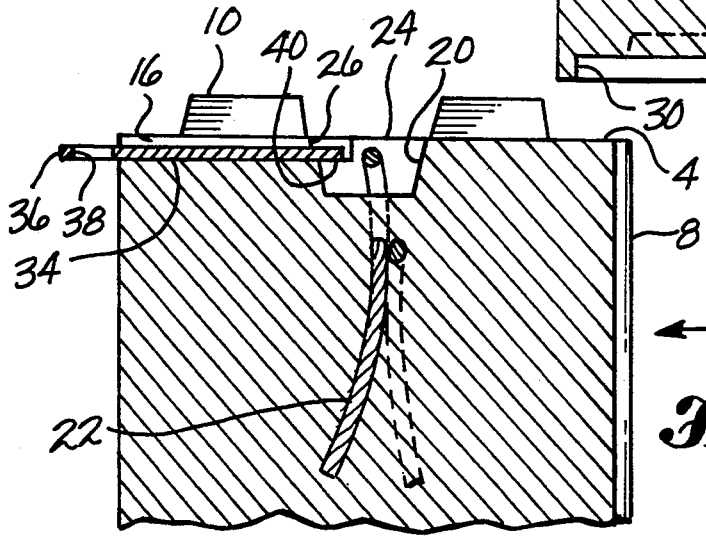
FIG. 9 is a cross-sectional view taken along line 9—9 in FIG. 2.

The channels 16, 20, 26 on the upper surface 4 have both anchoring and handling functions. The increased depth portion 20 of the main channel 16 receives the projecting eye portion 24 of a wire cable 22 whose ends are embedded in the concrete body of the block 2, as shown in FIGS. 6 and 9. The channel portion 20 is deep enough so that the projecting cable eye 24 is contained entirely within the channel portion 20 without extending above the plane of the upper surface 4, and is sufficiently large to enable the eye 24 to be engaged by a hook or other member for lifting and/or moving the block 2.

The T-shaped recess portion of the two channel configuration is shallower than the increased depth portion 20, except where it intersects the portion 20. The T-shaped recess is designed to accept a T-shaped anchor member when the breakaway wall 18 has been removed. FIGS. 1, 2, 5, and 9 illustrate the positioning of an anchor member 32 in the T-shaped recess. The anchor member 32 has a leg portion 34 which extends along the main channel 16. The outer end 36 of the leg 34 projects outwardly from the channel 16 and the body of the block 2, as shown in FIGS. 2 and 9. The outer end 36 has an opening 38 extending therethrough to permit a wire cable or other anchoring device to be attached to the member 32.

The head portion 40 of the anchor member 32 extends along the transverse channel 26. The transverse channel 26 is partially defined by an abutment sidewall 27 that is substantially parallel to and faces away from the edge of the upper surface 4 from which the outer leg end 36 projects. When an anchor cable is attached to the outer end 36 of the anchor member 32 and exerts anchoring forces thereon, these forces are reacted by the abutment of the head 40 of the anchor member 32 against the abutment sidewall 27. In this way, the anchor forces are spread along the length of the abutment sidewall 27, rather than being imposed on a single point of connection to the block 2.

The preferred configuration of the channels on the lower surface 6 can be seen in FIGS. 3–8. The lower surface 6 has two channels 28 that are parallel to and coextensive with each other. Each of the channels 28 has an outer end that terminates proximate to, but spaced a distance from, an edge of the lower surface 6. A breakaway wall 30 is defined between the outer end of the channel 28 and the edge. The wall 30 has a configuration essentially the same as that of the breakaway wall 18 on the upper surface 4. Each channel 28 extends inwardly from and perpendicular to the edge along which the breakaway walls 30 are formed. As can be seen in FIGS. 3–6, the channel 28 extends through the middle of the respective square portion of the lower surface 6 between the recesses 12. The portion of the channel 28 that intersects the vertical opening 14 has an increased width to accommodate the opening 14. The inner end of the channel 28 terminates at a midportion of the lower surface 6 about two-thirds of the way along the pair of recesses 12 opposite the edge at which the breakaway walls 30 are formed. The two channels 28 are spaced apart a distance such that, when the breakaway walls 30 are broken away, the channels 28 will admit the tines of a forklift to permit the forklift to maneuver the block 2. This is illustrated by the forklift tine 29 shown in broken lines in FIG. 4.

Figures 10, 10A:
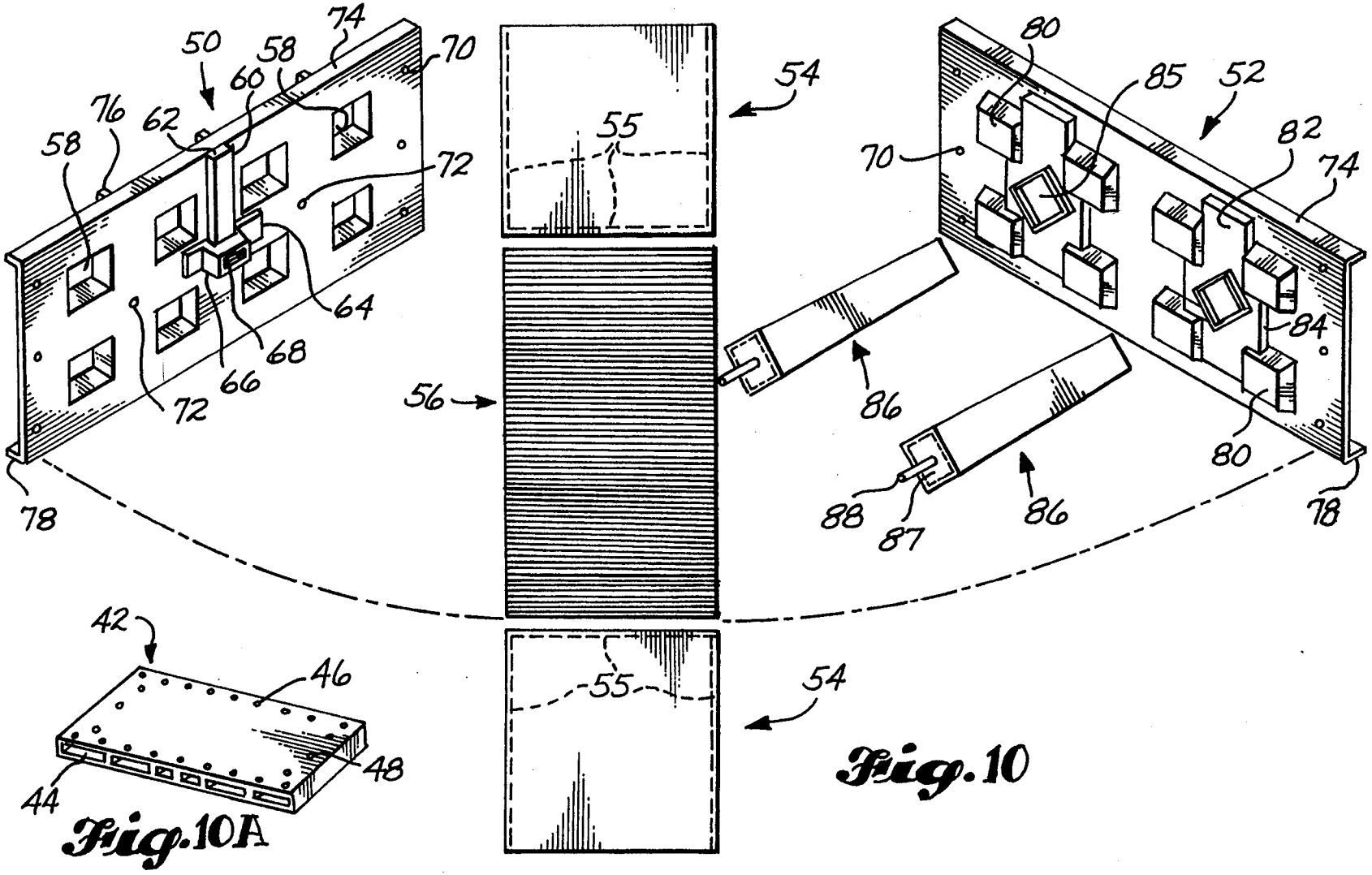
FIG. 10 is an exploded pictorial view of the mold for forming the block shown in FIGS. 1–9, excluding the base and with parts shown in elevation.
FIG. 10A is a reduced size pictorial view of the base portion of the mold shown in FIG. 10.

FIGS. 10 and 10A illustrate a mold for forming the concrete building block 2 shown in FIGS. 1–9. The mold comprises a plurality of walls releasably attachable to each other to define a cavity into which concrete can be poured. As used herein, the term "releasably" means that the respective members may be attached to each other and detached from each other repeatedly without damage to the members. This may be accomplished, for example, by means of nut and bolt connections. The mold walls include a base 42, shown in FIG. 10A. The base 42 has forklift openings 44 to permit the entire mold, with concrete therein, to be lifted and moved. The upper surface of the base 42 has a series of bolt holes 46 along each of its sides for securing the side walls of the mold to the base 42. Similarly, bolt holes 48 are provided along the ends of the upper surface for attaching the end walls of the mold.

In addition to the base 42, the mold includes a side wall 50 for forming the top of the block 2, a side wall 52 for forming the bottom of the block 2, and opposite end walls 54. The side and end walls 50, 52, 54 may have reinforcing members, such as the ribs 76 on wall 50 shown in FIG. 10. Each of the side walls 50, 52 has a bottom flange 78, and the end walls 54 have bottom flanges 55, for securing the walls 50, 52, 54 to the base 42. The flanges 55, 78 have bolt holes corresponding to the holes 46, 48 in the base 42. The additional elements of the mold shown in FIG. 10 are a corrugated foam plastic liner 56 and two slugs 86, described further below. When the walls 42, 50, 52, 54 of the mold are secured together, the liner 56 is laid on the top of the base 42 inside the cavity formed by the walls 42, 50, 52, 54. The corrugations of the liner 56 form the corrugated side surface 8 of the block 2.

The side wall 50 comprises a plurality of recesses 58 for forming the projections 10 on the upper surface 4 of the block 2. It also includes projections 60, 64, 66 for forming the channel configuration. The projection 60 forms the main channel 16. The projection 60has an end wall 62 substantially perpendicular to the wall 50 and spaced a distance from the edge of the wall 50 to form the breakaway wall 18 in the finished block 2. The projection 64 is perpendicular to the projection 60 and forms the transverse channel 26. The projection 66 forms an increased depth and increased width portion of the projection 60 and intersects the projection 64 to form the increased depth portion 20 of the main channel 16 in the finished block 2. All of the projections 60, 64, 66 project into the cavity formed by the walls 42, 50, 52, 54 to form the respective channels in the cast block. The projection 66 has an outer wall parallel to the mold wall 50. A slot 68 is formed in this outer wall to receive a connector, such as the eye portion 24 of the cable 22 described above, which is to extend into the increased depth channel portion 20 in the block 2. The wall 50 has an upper flange 74 and the lower flange 78 which attaches to the base 42. The wall 50 also has a plurality of bolt holes, denoted by the reference numeral 70 in FIG. 10, for attaching the end walls 54 thereto and two bolt holes 72 for attaching the slugs 86.

The side wall 52 for forming the bottom 6 of the block 2 also has side bolt holes 70, an upper flange 74, and a lower flange 78. A plurality of projections 80 are formed on the wall 52 to project into the mold cavity to form the bottom recesses 12 in the block 2. Two cross-shaped projections 82 are provided for forming the forklift channels 28. Each of the projections 82 has an enlarged width portion 84 that extends between the projections 80 for forming the increased width portion of the channel 28. A socket 85 is provided in the middle of the increased width portion 84 for the purpose described below.

In the assembled mold, the opposite ends of each of the two slugs 86 are attached to the opposite, spaced apart walls 50, 52. Each slug 86 has an elongated tapered tubular body with end walls 87. The tapering of the slug 86 facilitates its removal from the cast block 2. The larger end of the slug 86 has a bolt shaft 88 projecting therefrom. The bolt 88 is received into the corresponding hole 72 in the wall 50 to secure the slug 86 thereto. The opposite smaller end of the slug 86 is received into the corresponding socket 85 on the wall 52. The slug 86 could also be attached to the walls 50, 52 in various other ways, but is preferably releasably attached to each of the walls 50, 52. In the cast block, the removal of the slugs 86 from the body of the block creates the openings 14. During the casting procedure, the slugs 86 reinforce the mold structure.

Figure 12:
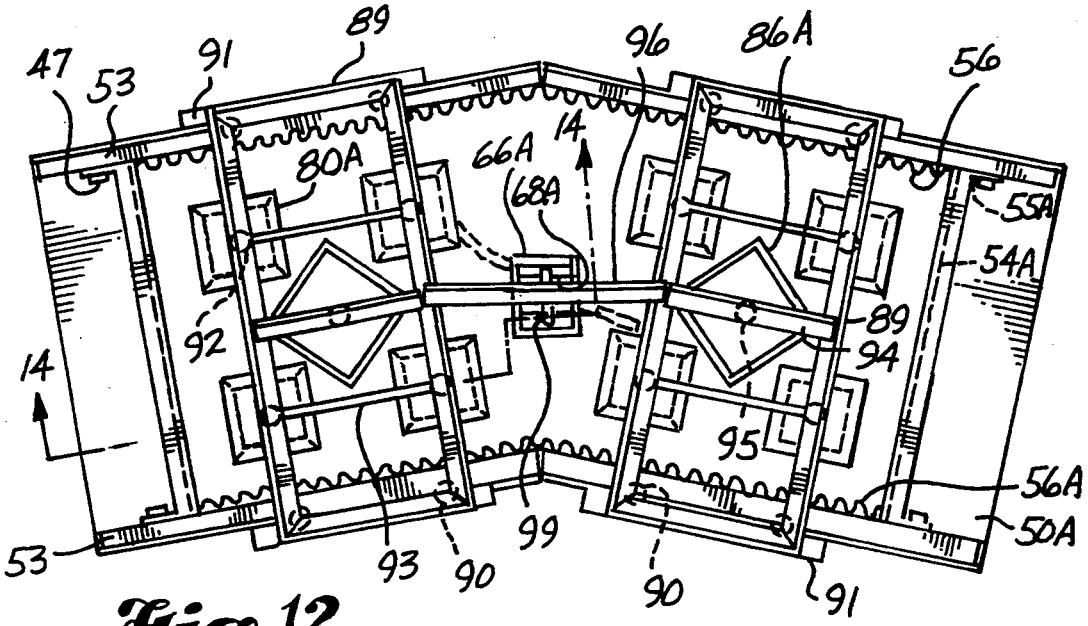
FIG. 12 is a top plan view of the mold for forming the block shown in FIG. 10.
Figure 13:
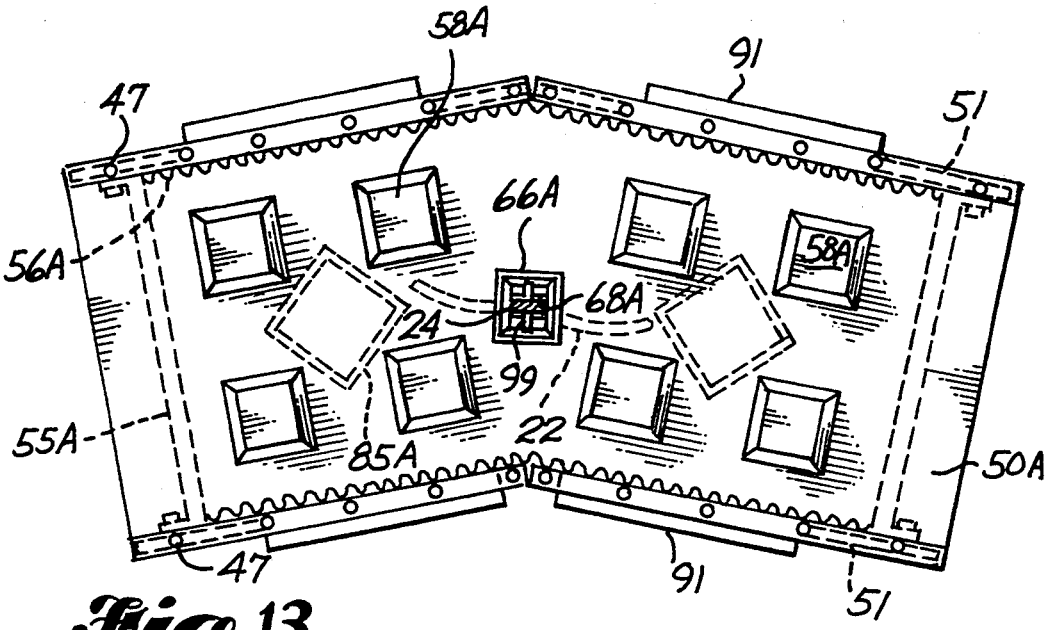
FIG. 13 is a bottom plan view of the mold shown in FIG. 12.
Figure 14:
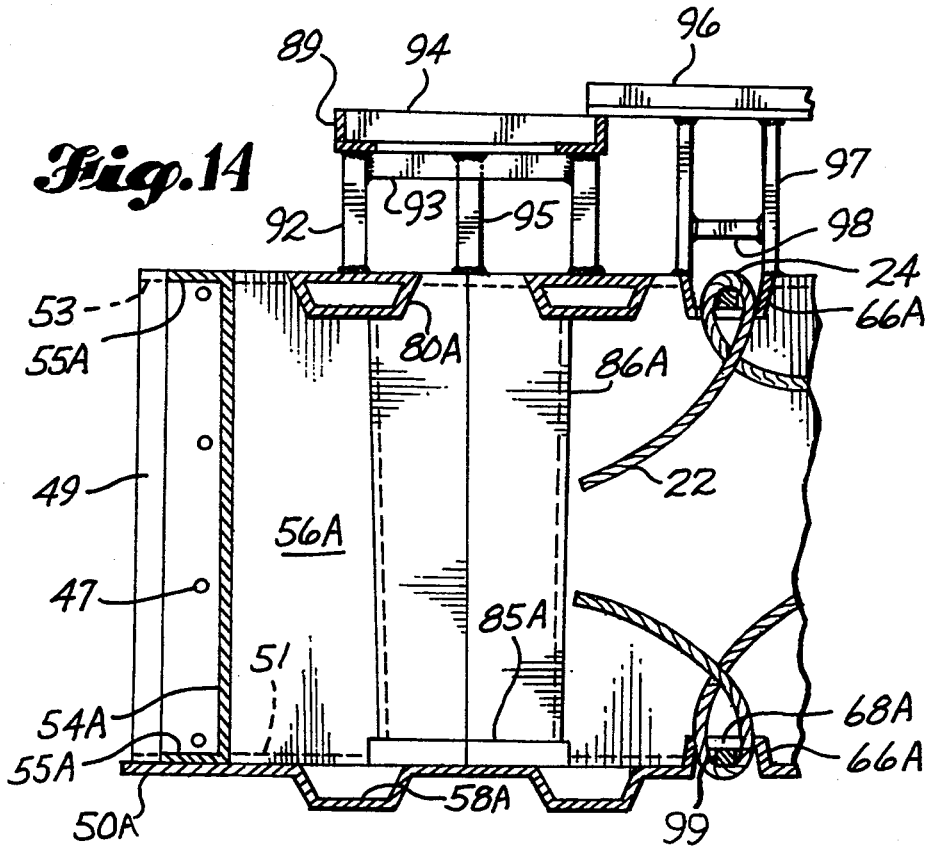
FIG. 14 is a fragmentary sectional view taken along line 14—14 in FIG. 12.

The preferred embodiment of the method of forming comprises releasably attaching the walls 50, 52, 54 to each other and the base 42 by means of bolts and nuts. Before the wall 50 is put into position, the slugs 86 are secured thereto by means of the bolts 88. The opposite ends of the slugs 86 are slipped into the sockets 85 when the two walls 50, 52 are brought together in their opposed positions. A metal cable 22 is positioned with its ends extending into the mold cavity and a loop or eye portion thereof projecting through the slot 68 in the projection 66 into the space that will form the increased depth channel portion 20 in the finished block 2. A piece of wood 99 is extended through the loop of the eye portion 24, as shown in FIGS. 12–14, to hold the cable 22 in position and to prevent seepage of concrete into the block channel 20.

When the mold has been fully assembled and the cable 22 positioned, the mold cavity is filled with concrete, which is allowed to harden into a block. After the concrete has hardened sufficiently, the walls 50, 52, 54 are released and separated from each other and from the base 42 by undoing the bolt connections and moving the walls 50, 52, 54 and base 42 relative to each other. The mold elements are also moved away from the hardened block. Movement of the wall 50 away from the block with the slugs 86 still attached thereto also serves to remove the slugs 86 from the block. This disengagement of the slugs 86 is unhampered by the wall 52 since the connection to the wall 52 is simply a sliding socket connection. The finished block 2 may be transported along with the base 42 by lifting the base 42 with a forklift. Alternatively, the block 2 may be moved by lifting it with a hoist or other device that engages the cable eye 24, or by breaking away the breakaway walls 30 and using a forklift.

Figure 11:
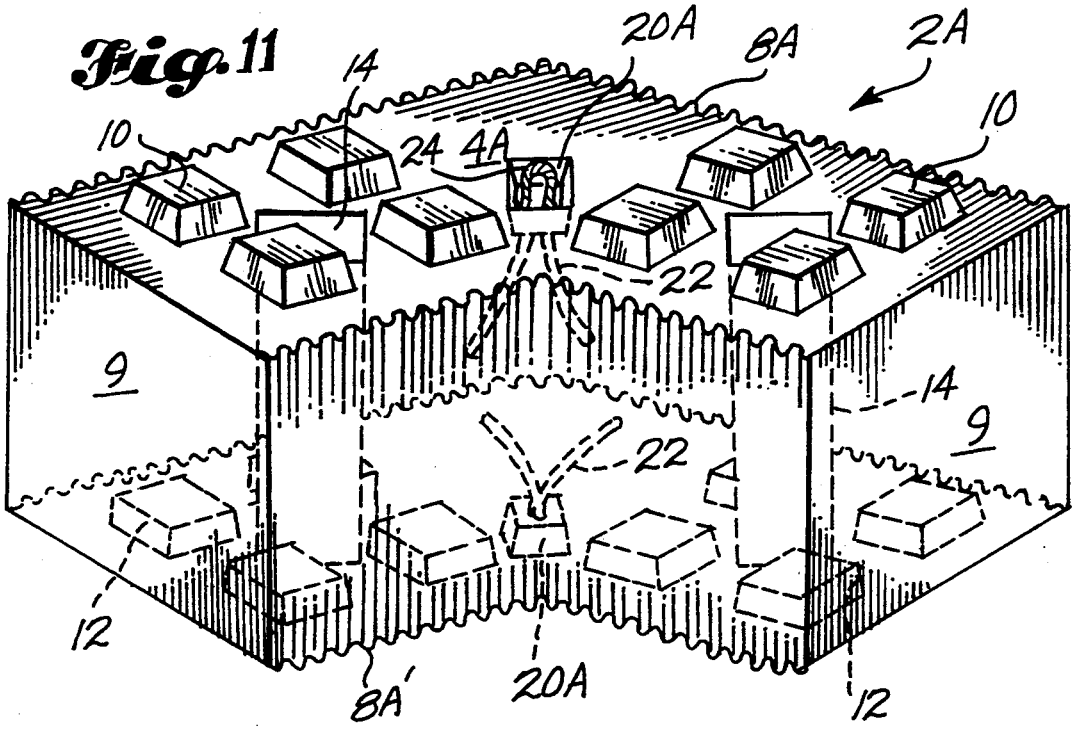
FIG. 11 is a pictorial view of another embodiment of the block.

FIG. 11 shows another embodiment of the block 2A. The block 2A has an upper surface 4A that, rather than being rectangular like the upper surface 4 of the block 2, has an angled configuration. As shown in FIGS. 11 and 12, the two halves of the surface 4A form an angle of about 150° with each other. The angle could of course be varied. For example, the block could form a right angle. Like the block 2, the block 2A has end surfaces 9, but the surfaces 9 are not parallel to each other because of the angled configuration of the upper surface 4A. Each of the two side surfaces 8A, 8A' extending between the end surfaces 9 is perpendicular to the end surfaces 9 and the upper surface 4A and has an angled configuration reflecting the configuration of the upper surface 4A. Like the block 2, the block 2A has two sets of four projections 10 on its upper surface 4A and two corresponding sets of four recesses 12 on its lower surface. A vertical opening 14 extends through the middle of each set of projections 10 and recesses 12. At the center of each of the top and bottom surfaces of the block 2A, a recess 20A is formed. An eye portion 24 of a cable 22 projects into each of the recesses 20A. The eye 24 on the bottom surface is included to facilitate moving the block 2A at the completion of the preferred forming procedure, in which the block 2A is cast upside down.

The block 2A may be used to form an angled portion of a wall. Since the projections 10 and recesses 12 are provided in the same pattern as in the block 2, blocks having the basic configuration of block 2 may be placed on top of or beneath the angled block 2A. The corrugations on both of the side surfaces 8A, 8A' allows the block 2A to be used for either a concave or a convex angle without impairing the appearance of the wall.

FIGS. 12–14 illustrate a mold for forming the block 2A. The mold comprises a bottom wall 50A for forming the top of the block 2A. The wall 50A has a plurality of recesses 58A for forming the projections 10. The wall 50A also has a projection 66A for forming the recess 20A. The projection 66A has a slot 68A that performs the same function as the slot 68 in the projection 66 in the mold shown in FIG. 10.

Still referring to FIGS. 12–14, the mold includes two angled side walls, one of which is indicated by the reference numeral 49 in FIG. 14, and two end walls 54A for forming the block's side walls 8A, 8A' and end walls 9, respectively. A corrugated foam plastic lining 56A is provided along the inside of each of the side walls to texture the block side walls. The end walls 54A have upper, lower, and side flanges 55A for securing the walls 54A to the mold side walls and bottom wall 50A. Each side wall has a bottom flange 51 for attaching it to the bottom wall 50A and a top flange 53. The attachments between the mold members 49, 50A, 54A are made by means of bolts 47.

The mold shown in FIGS. 12–14 is designed to cast the block 2A upside down. This orientation is chosen instead of the lateral orientation of the mold shown in FIG. 10 because of the need to form two, rather than one, corrugated side walls in the finished block 2A. The lower block surface is formed by means of an upper mold wall with an open structure. The preferred upper mold wall configuration takes the form of the framework shown in FIGS. 12 and 14. The framework includes two rectangular frames 89 formed by metal bars with L-shaped cross sections. There is one rectangular frame 89 for each set of recesses 12. Each frame 89 is spaced Above the tops of the side and end walls 49, 54A. The frame 89 is supported on the side walls by means of vertical posts 90. There are two posts 90 supporting each end of the frame 89. The top of each post 90 is welded to the bottom of the frame 89. One half of the bottom of the post 90 is welded to an engagement flange 91. The frame 89 is mounted on the side walls by sliding the two engagement flanges 91 under the top flange 53 of the side walls. The portion of each engagement flange 91 to which the posts 90 are welded extends laterally outwardly from the corresponding top flange 53, as shown in FIGS. 12 and 13. The inner portion of the bottom of each post 90 slides over the top of the flange 53 so that the flange 53 is gripped between the bottoms of the posts 90 and the engagement flange 91 to securely mount the frame 89 on the rest of the mold structure.

Each frame 89 carries four projections 80A for forming the recesses 12 in the bottom of the block 2A. Each projection 80A is suspended from the frame 89 by a support post 92. The top of the post 92 is welded to the frame 89, and the bottom is welded to the projection 80A, as shown in FIG. 14. Two cross braces 93, each having opposite ends welded to two of the posts 92, add rigidity to the recess forming structure.

The mold includes two slugs 86A for forming the vertical openings 14 in the block 2A. Each slug 86A extends between the upper wall or frame structure and the lower wall 50A. The bottom of the slug 86A is received into a socket 85A formed on the inside of the bottom wall 50A. The top of the slug 86A is welded to a support post 95. The top of the post 95 is welded to an L-shaped bar 94, which rests inside the rectangular frame 89. The slug support structure, comprising the bar 94 and the post 95, and the slug 86A may be easily removed from the rest of the mold as a unit since the bar 94 merely rests on the frame 89. In this sense, the slug and its support structure is releasably attached to the upper frame structure.

The upper portion of the mold further comprises a projection 66A for forming a recess 20A in the bottom of the block 2A for a metal cable eye 24. The upper projection 66A is suspended from a lateral support member 96 by means of two vertical bars 97, as shown in FIG. 14. A cross bar 98 between the two vertical bars 97 reinforces and stabilizes the support structure. The support member 96 rests on the tops of the opposite rectangular frames 89, as shown in FIGS. 12 and 14. This allows the recess forming structure to be easily positioned and removed with respect to the rest of the mold.

The system of the invention encompasses methods of using the blocks 2, 2A, 2B, 2C, as well as the blocks themselves and the method and apparatus for making the blocks. FIGS. 15 and 16 illustrate an aspect of the method of use in which a structure having first and second perpendicular walls is constructed. The second wall adjoins a midportion of the first wall. This aspect of the method employs two variations 2B, 2C of the block 2 shown in FIGS. 1–9. In order to facilitate description of the construction of the T-shaped wall, the basic rectangular block 2 shown in FIGS. 1–9 is hereinafter referred to as a "full size block". Each of the blocks 2B, 2C shown in FIGS. 15 and 16 is a modification of the full size block 2.

Referring to FIG. 15, the first modification is a notched block 2B. This block 2B has an upper surface 4B with a plurality of projections 10 extending upwardly therefrom. The block 2B is configured like the full size block 2 except that it has a square corner recess 7 extending through its body between its upper and lower surfaces. The recess 7 has a cross section with an area one quarter of the area of each square portion of the full size block 2, indicated by the phantom line in FIG. 4. The resulting configuration of the block 2B is that of the full size block with one corner corresponding to one projection 10 cut away. In the construction of the T-shaped wall, two notched blocks 2B, which are mirror images of each other, are used in a layer of blocks. The wall structure also includes the second modification which is a rectangular three-quarter size block 2C. The configuration of the three-quarter size block 2C is like the full size block 2 except that the area of its top and bottom surfaces comprises one and one half of the area of each square portion of the full size block 2. The three-quarter block 2C consequently has six, rather than eight, projections 10.

In the construction of the wall illustrated in FIGS. 15 and 16, the two notched blocks 2B are positioned end to end with their corner recesses 7 adjacent to each other, to form a part of the midportion of the first wall. An end portion of the three-quarter size block 2C is positioned in the corner recesses 7 in abutment with the notched blocks 2B. The wall formed by the notched blocks 2B and the perpendicular wall formed by the three-quarter size block 2C may then be extended using full size blocks 2.

The next layer of blocks is preferably formed entirely of full-size blocks 2, as illustrated in FIG. 16, which shows the next layer in phantom. A first full size block 2 is positioned above and interlocking with the two notched blocks 2B and the portion of the three-quarter size block 2C extending into the corner recesses 7. A different square portion of the bottom surface 6 of the full size block 2 is positioned over each of the notched blocks 2B. Additional full size blocks 2 are provided to interlock with the remaining square portions of the blocks 2B, 2C and with the full size blocks 2 in the first layer. Subsequent layers may be added, with layers consisting entirely of full size blocks 2 being alternated with layers forming the T-intersection by means of the modified blocks 2B, 2C. In this manner, the intersection of the two perpendicular walls is interlocked to stabilize both walls by means of a simple construction that requires only limited use of modified forms of the blocks.

FIG. 17 illustrates another aspect of the method of use in which a retaining wall 100 positioned to retain an embankment 102 is anchored to enhance the stability of the wall 100. The wall 100 is built from a plurality of full size blocks 2 arranged in staggered layers. As shown in FIG. 17, the breakaway wall 18 of one of the blocks 2 has been broken away and an anchor member 32 has been positioned in the T-shaped recess 16, 26 formed on the top surface of the block. One end of an anchor cable 104 has been secured to the projecting outer end 36 of the anchor member 32. The other end of the cable 104 is secured to a ring 108 carried by an anchor block 106. The anchor block 106 is embedded in the embankment 102 to firmly position it and securely prevent movement of the wall 100 relative to the embankment 102. The abutment of the anchor member 32 against the abutment side wall 27 of the transverse channel 26 reacts the anchor forces, as described above. The positioning of addition blocks 2 above the block on which the anchor member 32 is positioned helps to hold the anchor member 32 within the channel 16, 26.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. In combination:

structural building block comprising a concrete body which includes:

a top surface, an opposite bottom surface, and an opening extending through said body between and through said surfaces;

a channel in one of said surfaces, said channel extending from a midportion of said one surface toward an edge of said one surface and terminating in an outer end portion proximate to said edge;

a breakaway wall defined between said outer end portion and said edge, said wall being sufficiently thin and brittle to permit said wall to be broken away by use of hand tools and being configured to when in place prevent flow of concrete from said channel;

wherein said channel comprises a main channel, and said body further includes a transverse channel in said one surface; said transverse channel extending substantially perpendicular to and intersecting said main channel, said transverse channel being partially defined by an abutment sidewall that is substantially parallel to and faces away from said edge, and said transverse channel and said main channel together forming a substantially T-shaped recess in said one surface; and an anchor member positionable in said recess when said breakaway wall is broken away, said anchor member having a leg portion with an outer end that when said anchor member is positioned in said recess projects outwardly from said main channel for connection with an anchor cable, and a head portion that is positionable in said transverse channel in an abutting relationship with said abutment sidewall to transmit to said abutment sidewall anchor cable imposed forces which are imposed by an anchor cable that in use is secured to said outer end of said leg portion.

2. The combination of claim 1, further comprising a connector; said connector including an embedded portion embedded in said body, and an eye portion extending from said body into said channel.

3. The combination of claim 2, in which said channel includes an increased depth portion into which said eye portion extends.

4. The combination of claim 3, wherein said transverse channel intersects said increased depth portion of said main channel.

5. The combination of claim 1, in which said channel is a first channel in said bottom surface; and said body further includes a second channel in said bottom surface substantially parallel to and coextensive with said first channel, and a second breakaway wall defined between said second channel and said edge; wherein said channels are spaced apart a distance such that, when said breakaway walls are broken away, said channels will admit tines of a forklift to permit the forklift to maneuver the block.

6. The combination of claim 1, wherein said leg portion of said anchor member is sized slightly smaller than the dimensions of said main channel of said block, so that upon placing said anchor member in said recess, said leg portion substantially occupies said main channel.

7. The combination of claim 1, wherein said transverse channel is defined partially by a pair of spaced surfaces that are parallel with said one surface, so that upon placing said anchor member in said recess, said head portion of said anchor member is supported by said spaced surfaces.

8. In combination:

a structural building block comprising a concrete body that includes:

a top surface, and an opposite bottom surface; said surfaces having complementary interlocking portions arranged to cause said surfaces of a plurality of said blocks to automatically interlock when said blocks are positioned one atop another;

a substantially T-shaped recess formed in said top surface; said recess having a leg portion extending from a midportion of said top surface substantially to an edge of said top surface, and a head portion intersecting said leg portion and extending substantially parallel to said edge and substantially perpendicular to said leg portion; said head portion being partially defined by an abutment sidewall substantially parallel to and facing away from said edge, and a breakaway wall defined between said leg portion and said edge, and an anchor member positionable in said recess when said breakaway wall is broken, said anchor member having a leg portion with an outer end that projects outwardly from said leg portion of said recess when said anchor member is positioned in said recess, and a head portion that is positionable in said head portion of said recess in an abutting relationship with said abutment sidewall to transmit to said abutment sidewall anchor forces that are imposed by an anchor cable that in use is secured to said outer end of said leg portion.

9. A structural building block comprising a concrete body which includes:

a top surface, an opposite bottom surface, and an opening extending through said body between and through said surfaces;

a channel in one of said surfaces, said channel extending from a midportion of said one surface toward an edge of said one surface and terminating in an outer end portion proximate to said edge;

a breakaway wall defined between said outer end portion and said edge, said wall being sufficiently thin and brittle to permit said wall to be broken away by use of hand tools and being configured to prevent flow of concrete from said channel; and a connector, said connector including an embedded portion embedded in said body, and an eye portion extending from said body into said channel.

10. The block of claim 9, in which said channel includes an increased depth portion into which said eye portion extends.

11. The block of claim 9, in which said channel is a first channel in said bottom surface; and said body further includes a second channel in said bottom surface substantially parallel to and co-extensive with said first channel, and a second breakaway wall defined between said second channel and said edge; wherein said channels are spaced apart a distance such that, when said breakaway walls are broken away, said channels will admit tines of a forklift to permit the forklift to maneuver the block.

12. In combination:

a structural building block comprising a concrete body which includes:

a top surface, an opposite bottom surface, and an opening extending through said body between and through said surfaces;

a channel in one of said surfaces, said channel extending from a midportion of said one surface toward an edge of said one surface and termination in an outer end portion proximate to said edge;

a breakaway wall defined between said outer end portion and said edge, said wall being sufficiently thin and brittle to permit said wall to be broken away by use of hand tools and being configured to prevent flow of concrete from said channel;

a connector, said connector including an embedded portion embedded in said body, and an eye portion extending from said body into said channel;

said channel comprising a main channel, and said body further includes a transverse channel in said one surface, said transverse channel extending substantially perpendicular to and intersecting said main channel, said transverse channel being partially defined by an abutment sidewall that is substantially parallel to and faces away from said edge, and said transverse channel and said main channel together forming a substantially T-shaped recess in said one surface; and an anchor member positionable in said recess when said breakaway wall is broken away; said anchor member having a leg portion with an outer end that projects outwardly from said main channel when said anchor member is positioned in said recess, for connection to an anchor cable, and a head portion that is positionable in said transverse channel in an abutting relationship with said abutment sidewall to transmit to said abutment sidewall anchor cable forces which are imposed by an anchor cable that in use is secured to said outer end of said leg portion.

13. The block of claim 9, in which said channel comprises a main channel, and said body further includes a transverse channel in said one surface extending substantially perpendicular to and intersecting said main channel and forming, with said main channel, a substantially T-shaped recess in said one surface; said transverse channel being partially defined by an abutment sidewall that is substantially parallel to and faces away from said edge to transmit anchor forces, imposed by an anchor member positioned in said recess in an abutting relationship with said abutment sidewall and connected to a remote anchor point, to said abutment sidewall.

* * * * *